US008001689B2

(12) United States Patent
Lindgren et al.

(10) Patent No.: US 8,001,689 B2
(45) Date of Patent: Aug. 23, 2011

(54) PROCESS FOR FORMING A VARIABLE GAUGE METAL SHEET INTO A DESIRED SHAPE

(75) Inventors: Bo Axel Lindgren, Aurora (CA); Wayne W. C. Wong, Richmond Hill (CA)

(73) Assignee: Van-Rob Inc., Aurora, Ontario (CA)

( * ) Notice: Subject to any disclaimer, the term of this patent is extended or adjusted under 35 U.S.C. 154(b) by 1536 days.

(21) Appl. No.: 11/362,524

(22) Filed: Feb. 27, 2006

(65) Prior Publication Data

US 2007/0193010 A1 Aug. 23, 2007

(30) Foreign Application Priority Data

Feb. 23, 2006 (CA) ..... 2537521

(51) Int. Cl.
*B21D 53/88* (2006.01)

(52) U.S. Cl. ..... 29/897.2; 29/897.35; 72/379.2; 72/380; 72/381

(58) Field of Classification Search ..... 29/897.35, 29/897.3, 897.312, 897.2; 72/313, 381, 347, 72/379.2

See application file for complete search history.

(56) References Cited

U.S. PATENT DOCUMENTS 3,209,432 A * 10/1965 Cape ..... 29/897.2
5,239,852 A 8/1993 Roper

OTHER PUBLICATIONS

Michael Tolinski, Bend Blemish-Free Appliance Exteriors, Forming & Fabricating, Apr. 2003 vol. 10 No. 4.

* cited by examiner

*Primary Examiner* — Rick K Chang
(74) *Attorney, Agent, or Firm* — Riches, McKenzie & Herbert LLP

(57) ABSTRACT

The present invention relates to a process for forming a variable gauge metal sheet into a desired shape, said process comprising: providing a variable gauge metal sheet having a first surface and a second surface, the metal sheet having a thickness measured at any point on the metal sheet as the distance between the first surface and the second surface, the thickness of the metal sheet being different over a first portion of the sheet than over a second portion of the sheet, and forming said metal sheet into a first desired shape by bending the metal sheet about a first fold line, said first fold line extending through both the first portion and the second portion, to bring segments of the first surface of the metal sheet on either side of the first fold line into increased opposition with each other.

20 Claims, 15 Drawing Sheets

PROCESS FOR FORMING A VARIABLE GAUGE METAL SHEET INTO A DESIRED SHAPE

SCOPE OF THE INVENTION

The present invention relates to manufacturing metal components. More specifically, the present invention relates to a process for forming a variable gauge metal sheet into a metal component having a desired shape

BACKGROUND OF THE INVENTION

It is known to use blank metal sheets to manufacture various types of metal components. Such blank metal sheets are bent and formed into the desired shape. The bending of a metal sheet comprises plastically deforming the metal and changing its shape. The metal is stressed beyond the yield strength, but below the ultimate tensile strength so as to not break the metal sheet into pieces. For example, in tube making, blank metal sheets are bent so as to form hollow beams. As another example, metal sheets are bent to form various automotive parts, such as tie bars in the radiator support assembly.

In prior art, the bending or folding of metal sheets is accomplished by the use of press brakes. A typical prior art press brake comprises: (i) a moveable upper tool called a punch or ram; and (ii) a stationary lower tool called a die. The die has a V-shaped opening on its upper surface. A metal sheet is placed flat on the upper surface of the die over the V-shaped opening. The punch is moved downwards along a vertical axis to push down against the metal sheet and presses the metal sheet into the V-shaped opening. As a result of this downward pressure from the punch, the metal sheet is bent into a desired shape, a V-shaped bend.

Several problems arise when attempting to bend blank metal sheets by using a press brake. First, when the moveable punch presses the metal sheet down into the V-shaped opening, there is significant rubbing and sliding between the surface of the metal sheet and both the surfaces of the moveable punch and the stationary die, and this often results in shoulder marks or scratches on the surface of the metal sheet. Therefore, refinishing is required after the bending procedure.

Alternatively, the surface damage caused by press brake tooling can be reduced using urethane tooling or polymer die inserts. However, such provisions increase the cost of manufacturing.

Further, as the moveable punch is released from the bent metal sheet, there is a tendency for the metal sheet to lose some of its bent shape. This problem is known in the art as "springback". The amount of springback depends on several factors including the type of material, thickness, grain and temper. Springback is known to be very pronounced when the metal sheet comprises high-strength steel and aluminum alloy. Generally, the springback ranges from about 5 to 10 degrees.

In an effort to reduce the problem of springback, press brakes are often designed to bend the metal sheet to a greater angle than desired, thus taking the springback into account. However, this requires the carrying out of complex calculations to predict the degree of springback. Further, because there are so many factors involved in determining the amount of springback, including material, thickness, grain and temper, it is very difficult to accurately predict. Moreover, the costs and labour time required to make the necessary adjustments to the press brake, including the size and shape of the punch, the size and shape of the V-shaped opening in the die, and the downward pressure of the punch, are high.

For many metal components, it is desirable to form the metal component from a variable gauge metal sheet, or a metal sheet having a varying thickness profile. Such variable gauge metal sheets have the advantage of being able to form components which are lighter in weight because the sheet is thinner in areas which will be subjected to a lesser load than the load applied to thicker areas of the sheet. Also, less metal material is required to form the metal component. By selectively varying the thickness profile of the metal sheet, the function of the component can be optimized. Further, the varied thickness profile of the metal sheet offers greater possibilities for form design.

However, the bending of variable gauge metal sheets runs into the same problems as the bending of regular metal sheets which are mentioned above. Further, the bending of variable gauge metal sheets is even more difficult because it is more complicated to bend such metal sheets along a straight fold line where the thickness of the metal sheet varies along said fold line.

As mentioned above, the amount of springback varies according to the thickness of the metal sheet being bent. Therefore, where a metal sheet has a variable thickness profile, and the metal sheet is bent along a fold line where the thickness of the metal sheet varies along said fold line, the amount of springback will also vary along the fold line. This results in the metal sheet having a warped shape, with a greater amount of springback on one side of the metal sheet than the other. Further, it is difficult to design a press brake which takes into account springback when the amount of springback varies along the fold line. In this case, the amount of springback must be predicted at every point along the fold line.

SUMMARY OF THE INVENTION

It is an object of the present invention to provide a process for forming a variable gauge metal sheet into a desired shape.

It is a further object of the present invention to form metal components of lightweight construction.

A further object of the present invention is to form metal components having a variable thickness which is adapted to the respective load to which the component is to be subjected.

A further object of the present invention is to form a variable gauge metal sheet into a desired shape without scratching or marking the surface of the metal sheet.

A further object of the present invention is to form a variable gauge metal sheet into a desired shape with less springback.

A further object of the present invention is to provide a process for forming a variable gauge metal sheet into a desired shape which is relatively inexpensive and does not require significant tooling maintenance.

Accordingly, in one aspect, the present invention provides a process for forming a variable gauge metal sheet into a desired shape, said process comprising: providing a variable gauge metal sheet having a first surface and a second surface, the metal sheet having a thickness measured at any point on the metal sheet as the distance between the first surface and the second surface, the thickness of the metal sheet being different over a first portion of the sheet than over a second portion of the sheet, and forming said metal sheet into a first desired shape by bending the metal sheet about a first fold line, said first fold line extending through both the first portion and the second portion, to bring segments of the first surface of the metal sheet on either side of the first fold line into increased opposition with each other, wherein said bending of the metal sheet is effected by holding the metal sheet on a first clamped side of the first fold line secured between a first clamping die and a second clamping die while applying forces to the second surface of the metal sheet on a second moved side of the first fold line, wherein the first clamping die has a first engagement surface which engages the first surface of the metal sheet and is a complementary mirror image to a surface contour of the first surface of the metal sheet that it engages, wherein the second clamping die has a second engagement surface which engages the second surface of the metal sheet and is a complementary mirror image to a surface contour of the second surface of the metal sheet that it engages.

Preferably, the bending of the metal sheet about the first fold line urges the first surface of the metal sheet on the second moved side of the first fold line into a first stationary die block, said first stationary die block having a first engagement surface which engages the first surface of the metal sheet and is a complementary mirror image to the surface contour of the first surface of the metal sheet into which it is urged.

It is also preferred that a second moving die block is moved into engagement with the second surface of the metal sheet on the second moved side of the first fold line to urge the first surface of the metal sheet on the second moved side of the first fold line into the first stationary die block, the second moving die block having a second engagement surface which engages the second surface of the metal sheet and is a complementary mirror image to the surface contour of the second surface of the metal sheet into which it is urged.

The first fold line can lie in the second surface of the metal sheet spaced away from the first surface of the metal sheet and the bending about the first fold line is effected by a method selected from the group consisting of wing bending and tangent bending.

In a preferred embodiment, the first fold line extends along the metal sheet from a first end of the metal sheet to a second end of the metal sheet, with a central plane intermediate the ends of the metal sheet and normal to the first fold line, the thickness of the metal sheet being substantially symmetrical along the central plane.

The process of the present invention can further comprise forming said metal sheet into a second desired shape by bending the metal sheet about a second fold line, the second fold line extending through the first portion and the second portion to bring segments of the first surface of the metal sheet on either side of the second fold line into increased opposition with each other. The bending of the metal sheet about the second fold line is effected by holding the metal sheet on a first clamped side of the second fold line secured between a third clamping die and a fourth clamping die while applying forces to the second surface of the metal sheet on a second moved side of the second fold line. The third clamping die has a first engagement surface which engages the first surface of the metal sheet and is a complementary mirror image to the surface contour of the first surface of the metal sheet that it engages. Also, the fourth clamping die has a second engagement surface which engages the second surface of the metal sheet and is a complementary mirror image to the surface contour of the second surface of the metal sheet that it engages.

Preferably, the process of the present invention further comprises forming said metal sheet into a third desired shape by bending the metal sheet about a third fold line. The third fold line extends through both the first portion and the second portion and the bending about the third fold line brings segments of the first surface of the metal sheet on either side of the third fold line into increased opposition with each other. The metal sheet is held on a first clamped side of the third fold line secured between a fifth clamping die and a sixth clamping die while forces are applied to the second surface of the metal sheet on a second moved side of the third fold line. It is preferred that the fifth clamping die have a first engagement surface which engages the first surface of the metal sheet and is a complementary mirror image to the surface contour of the first surface of the metal sheet that it engages, while the sixth clamping die has a second engagement surface which engages the second surface of the metal sheet and is a complementary mirror image to the surface contour of the second surface of the metal sheet that it engages.

The metal sheet can be formed into the desired shape by wing bending. In wing bending, a metal sheet is secured by two clamping dies: one clamping die on top of the metal sheet; and one clamping die below the metal sheet. A moving die, which is called the wing, is moved into engagement with the bottom surface of the metal sheet at a location away from the two clamping dies. The metal sheet is bent about a fold line along the metal sheet. The moving die or wing rotates about an axis which is parallel to fold line, thus pushing against the bottom surface of the metal sheet and bending the metal sheet about the fold line up into the desired shape.

Advantageously, the process of the present invention produces a metal component having a lightweight construction.

Further, the metal component formed by the process of the present invention has a variable thickness which is adapted to the respective load to which the component is to be subjected.

The bending of the variable gauge metal sheet in the process of the present invention puts stress across the whole width of the metal sheet along the fold line and thus, results in less, if any, scratching and marking.

The process of the present invention surprisingly reduces the amount of springback compared to the use of prior art press brakes, particularly for high strength metal sheets such as high strength steel.

Further, where the first fold line extends along the metal sheet from a first end of the metal sheet to a second end of the metal sheet, with a central plane intermediate the ends of the metal sheet and normal to the first fold line, and the thickness of the metal sheet is substantially symmetrical along the central plane, any springback which occurs will be in an amount that is equal on each side of the central plane.

The process of the present invention is relatively inexpensive. For example, the tooling in press brakes are expensive to manufacture because of complex features such as the stationary die with a customized V-shaped opening. Further, press brakes are generally manually operated and often require two operators to bend larger metal sheets. In contrast, in the process of the present invention, only one operator is required, thus potentially cutting labour time in half Further, there is less tooling maintenance involved because there is no taping or waxing as required in maintaining a press brake.

Advantageously, the varied thickness profile of the sheet metal offers greater possibilities for the form design.

BRIEF DESCRIPTION OF THE DRAWINGS

Further aspects and advantages will become apparent from the following description taken together with the accompanying drawings in which.

Throughout all the drawings and the disclosure, similar parts are indicated by the same reference numerals.

DESCRIPTION OF THE PREFERRED EMBODIMENTS

Figure 1:
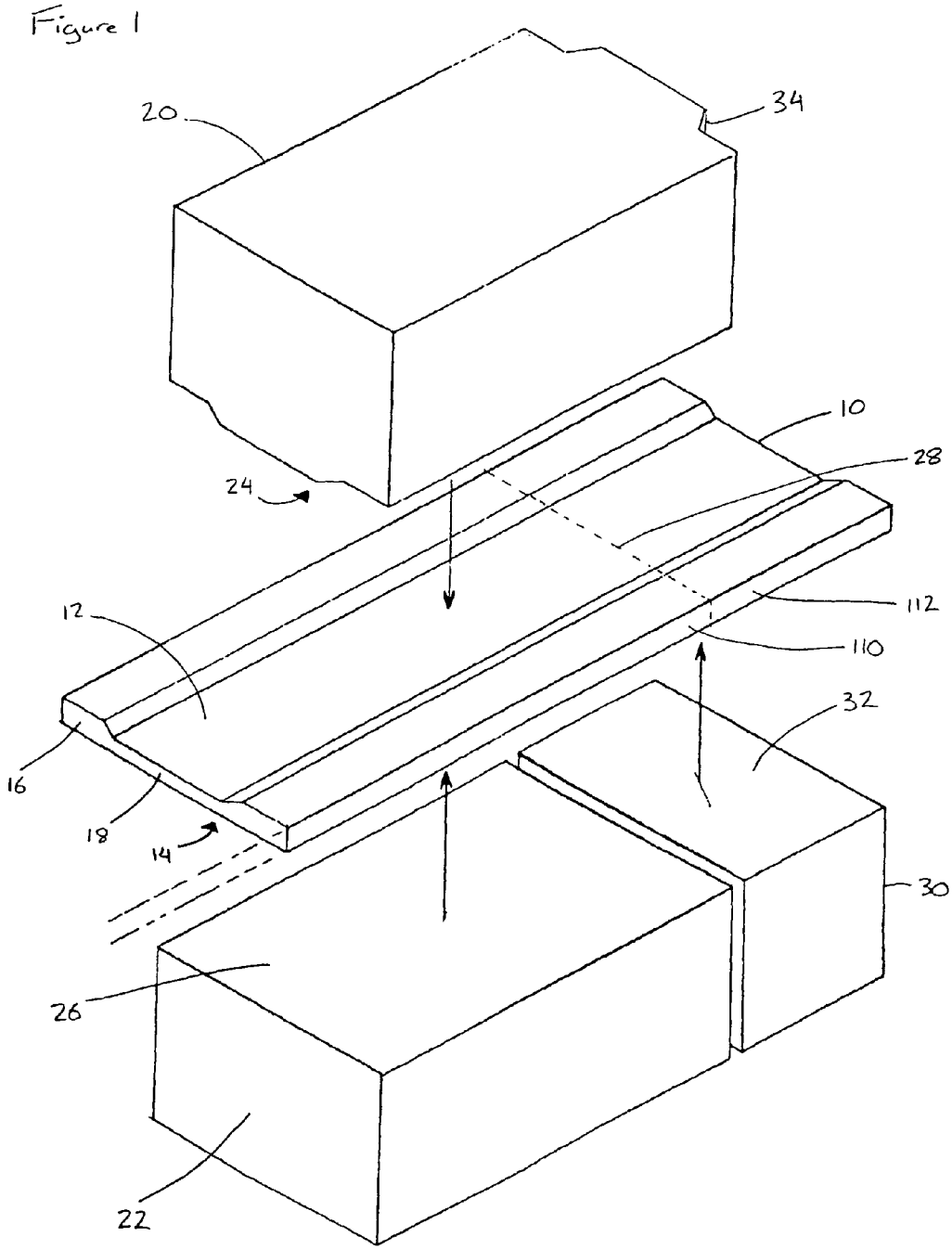
FIG. 1 is a perspective view of a variable gauge metal sheet, a first clamping die, a second clamping die and a second moving die block to be used in accordance with a first embodiment of the present invention.

FIG. 1 illustrates a variable gauge metal sheet 10 to be shaped by a process in accordance with a first preferred embodiment of the present invention. The variable gauge metal sheet 10 has a first surface 12 and a second surface 14. In this first preferred embodiment, as shown in FIG. 2, the first surface 12 is non-planar, while the second surface 14 is planar.

The variable gauge metal sheet 10 has a thickness measured at any point on the metal sheet 10 as the distance between the first surface 12 and the second surface 14. As can be seen in FIG. 1, the thickness of the metal sheet 10 is greater at a first portion 16 than at a second portion 18. FIG. 1 also shows a first fold line 28 which extends through both the first portion 16 and the second portion 18.

Figure 2:
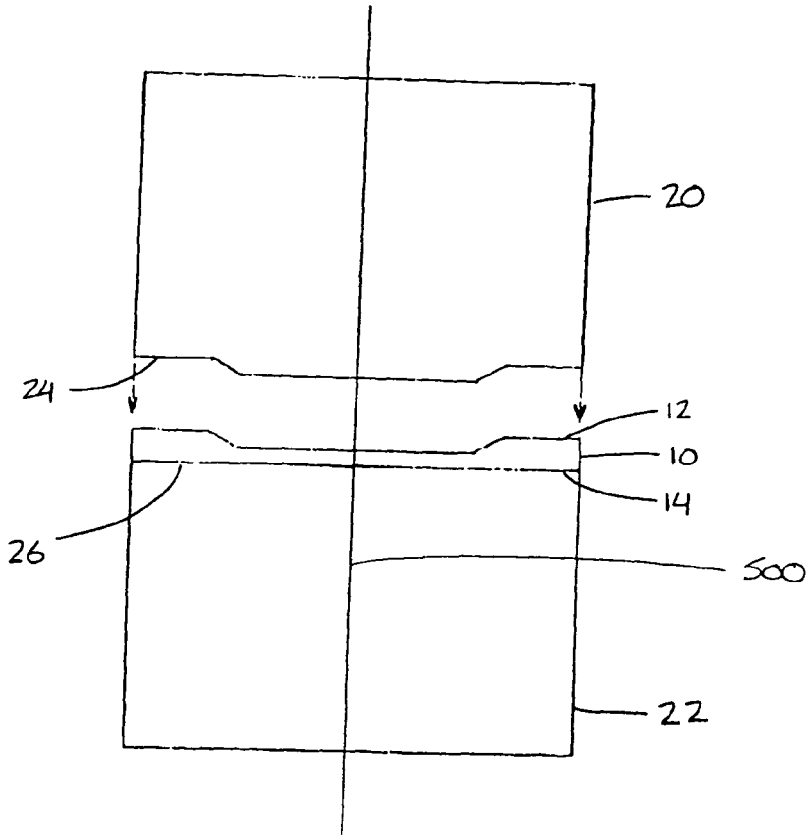
FIG. 2 is a cross-sectional view of the variable gauge metal sheet, the first clamping die and the second clamping die of FIG. 1, wherein the first clamping die has not yet come into contact with the metal sheet.

As shown in FIG. 2, a longitudinal central plane 500 is normal to the first fold line 28 and divides the metal sheet 10 into two halves. In this preferred embodiment, the thickness of the metal sheet 10 is symmetrical along the central plane 500.

Figure 3:
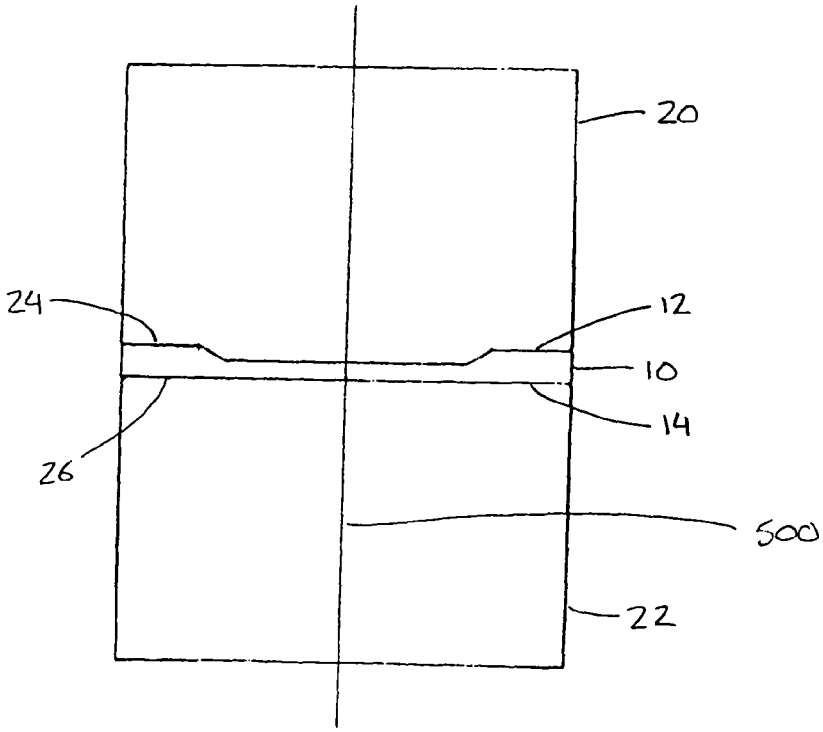
FIG. 3 is a cross-sectional view of the variable gauge metal sheet, the first clamping die and the second clamping die of FIG. 1, wherein the metal sheet is secured between the first clamping die and the second clamping die.

In the process of the present invention, the variable gauge metal sheet 10 is bent into a first desired shape. The metal sheet 10 is secured between a first clamping die 20 and a second clamping die 22, as shown in FIGS. 1 to 3. The first clamping die 20 acts as a first clamping die in having a first engagement surface 24 which engages the first surface 12 of the metal sheet 10 and is a complementary mirror image to the surface contour of the first surface 12 of the metal sheet 10 that it engages. Similarly, the second clamping die 22 has a second engagement surface 26 which engages the second surface 14 of the metal sheet 10 and is a complementary mirror image to the surface contour of the second surface 14 of the metal sheet 10 that it engages.

Figure 4:
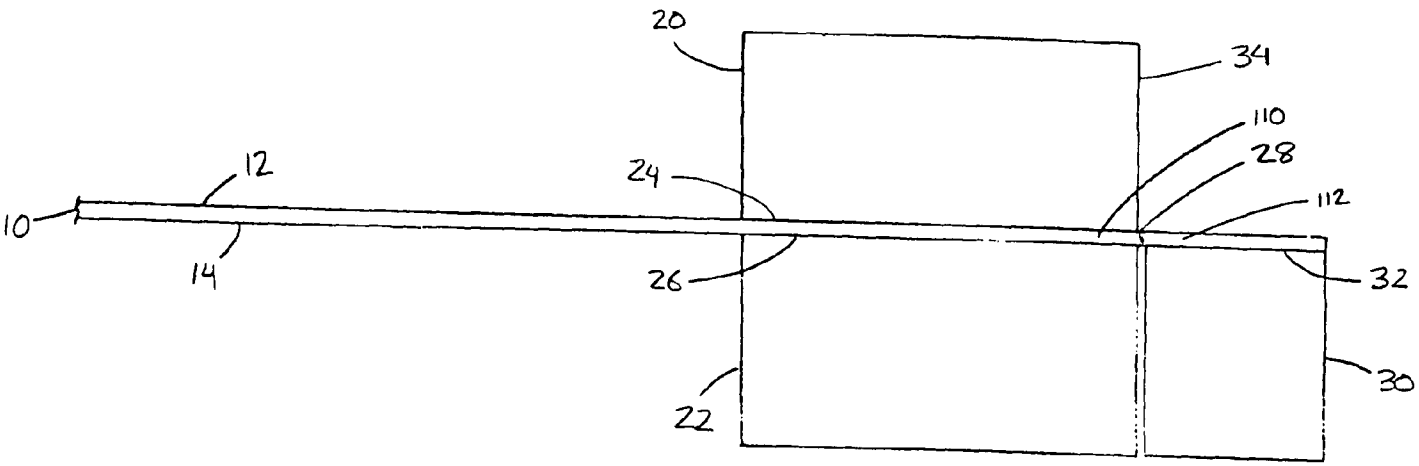
FIG. 4 is a side view of the variable gauge metal sheet, of FIG. 1, wherein the metal sheet is secured between the first clamping die and the second clamping die, and the second moving die block is moved into engagement with the metal sheet.
Figure 5:
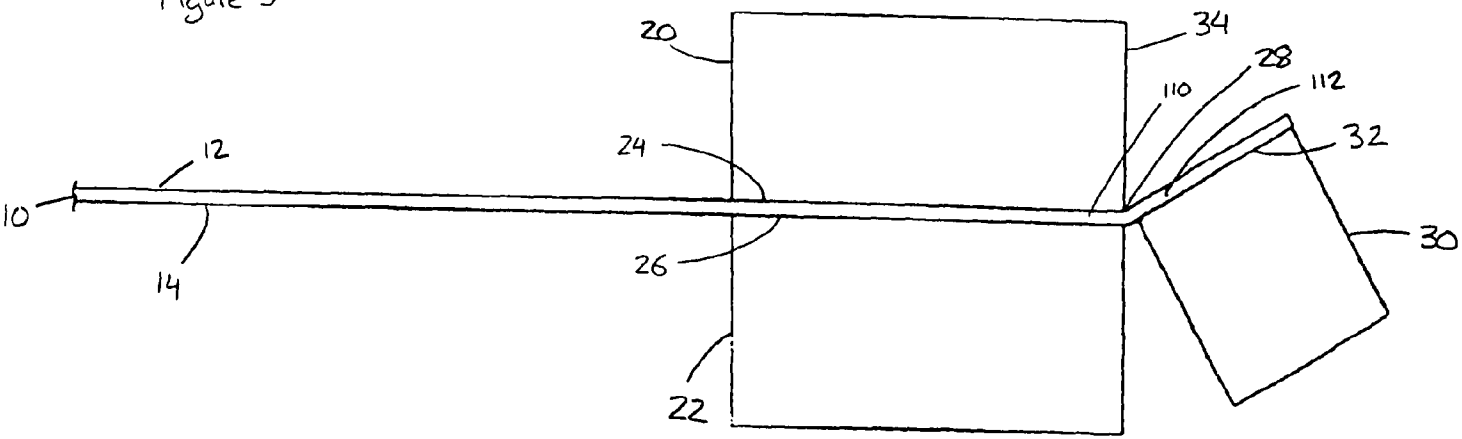
FIG. 5 is a side view of the variable gauge metal sheet of FIG. 4, wherein the second moving die block pushes up against the metal sheet to bend the metal sheet about a first fold line.
Figure 6:
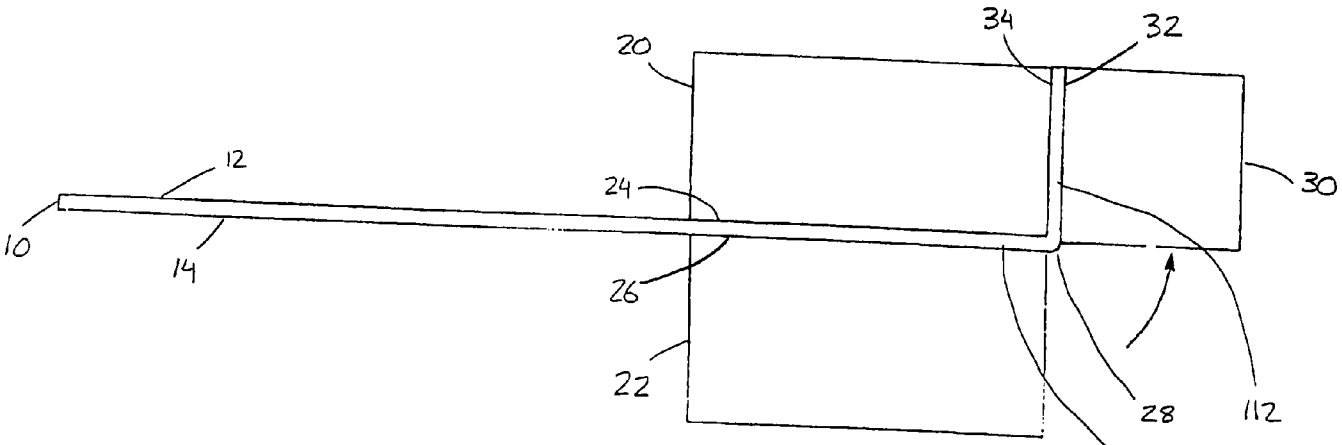
FIG. 6 is a side view of the variable gauge metal sheet of FIG. 5, wherein the metal sheet has been bent about the first fold line such as to urge the metal sheet into the first stationary die block, thus forming a first desired shape.

FIGS. 4 to 6 illustrate forming the metal sheet 10 into a first desired shape. The metal sheet is bent about a first fold line 28, wherein the first fold line 28 extends through both the first portion 16 and the second portion 18 of the metal sheet 10. On either side of the first fold line 28 is a first clamped side 110 and a second moved side 112.

In this preferred embodiment, the first clamping die 20 also acts as a first stationary die block in having a first engagement surface 34. As shown in FIG. 4, a second moving die block 30 is moved into engagement with the second surface 14 of the metal sheet 10 on the second moved side 112 of the first fold line 28. The second moving die block 30 has a second engagement surface 32 which engages the second surface 14 of the metal sheet 10 and is a complementary mirror image to the surface contour of the second surface 14 of the metal sheet 10 into which it is urged.

As shown in FIG. 5, the second moving die block 30 pushes up against the second surface 14 of the metal sheet 10 to bend the metal sheet 10 about the first fold line 28 such as to bring segments of the first surface 12 of the metal sheet 10 on either side of the first fold line 28 into increased opposition with each other.

As shown in FIG. 6, the bending of the metal sheet 10 about the first fold line 28 urges the first surface 12 of the metal sheet 10 on the second moved side 112 of the first fold line 28 into the first stationary engagement surface 34 of the first die block 20. The first stationary die block 20 has the first engagement surface 34 which engages the first surface 12 of the metal sheet 10 and is a complementary mirror image to the surface contour of the first surface 12 of the metal sheet 10.

Figure 7:
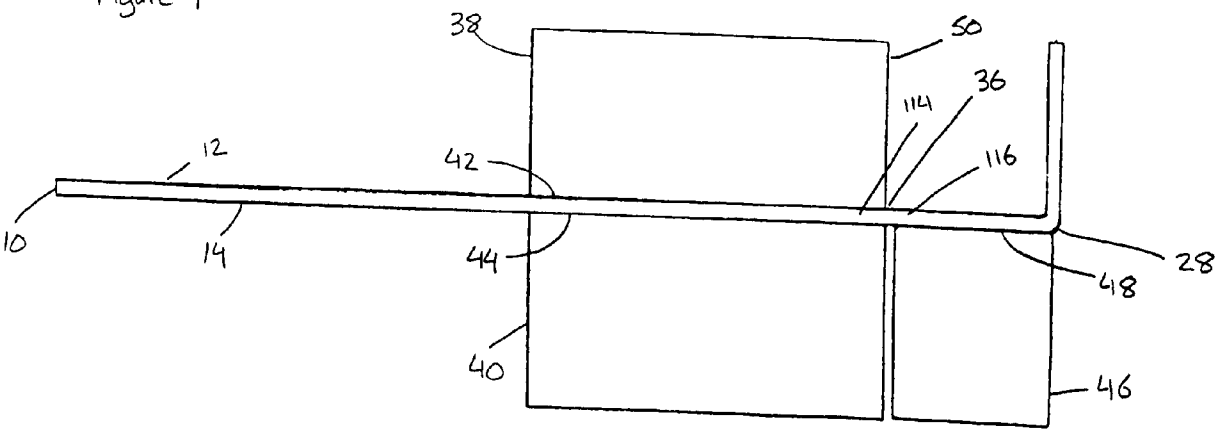
FIG. 7 is a side view of the variable gauge metal sheet of FIG. 6, wherein the metal sheet is secured between a third clamping die, and a fourth clamping die and a fourth moving die block is moved into engagement with the metal sheet.
Figure 8:
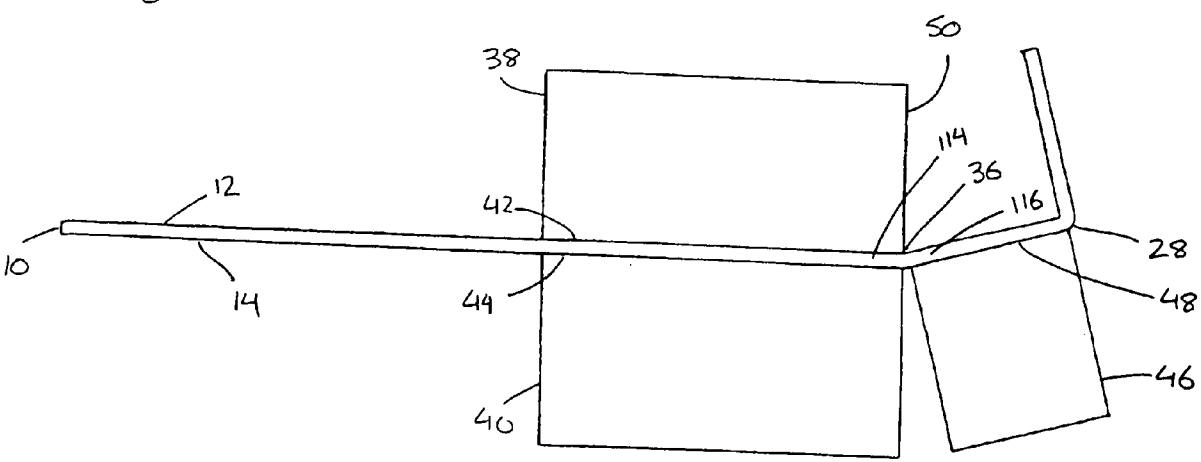
FIG. 8 is a side view of the variable gauge metal sheet of FIG. 7, wherein the fourth moving die block pushes up against the metal sheet to bend the metal sheet about a second fold line.
Figure 9:
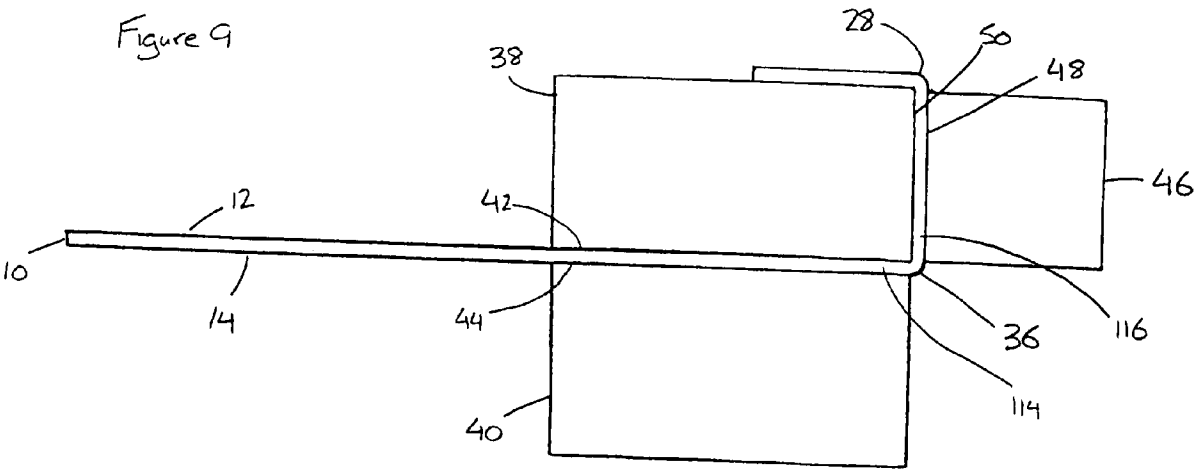
FIG. 9 is a side view of the variable gauge metal sheet of FIG. 8, wherein the metal sheet has been bent about the second fold line such as to urge the metal sheet into the third stationary die block, thus forming a second desired shape.

FIGS. 7 to 9 illustrate forming the metal sheet 10 into a second desired shape. The metal sheet 10 is bent about a second fold line 36 in a manner similar to the above-mentioned bending about the first fold line 28. The second fold line 36 extends through both the first portion 16 and the second portion 18 of the metal sheet 10. On either side of the second fold line 36 is a first clamped side 114 and a second moved side 116.

The metal sheet 10 is held on the first clamped side of the second fold line 36 between a third clamping die 38 and a fourth clamping die 40. The third clamping die 38 acts as a third clamping die in having a first engagement surface 42 which engages the first surface 12 of the metal sheet 10 and is a complementary mirror image to the surface contour of the first surface 12 of the metal sheet 10 that it engages. The fourth clamping die 40 has a second engagement surface 44 which engages the second surface 14 of the metal sheet 10 and is a complementary mirror image to the surface contour of the second surface 14 of the metal sheet 10 that it engages.

In this preferred embodiment, the third clamping die 38 also acts as a third stationary die block in having a first engagement surface 50. As shown in FIG. 7, a fourth moving die block 46 is moved into engagement with the second surface 14 of the metal sheet 10 on the second moved side 116 of the second fold line 36. The fourth moving die block 46 has a second engagement surface 48 which engages the second surface 14 of the metal sheet 10 and is a complementary mirror image to the surface contour of the second surface 14 of the metal sheet 10 into which it is urged.

As shown in FIG. 8, the fourth moving die block 46 pushes up against the second surface 14 of the metal sheet 10 to bend the metal sheet 10 about the second fold line 36 such as to bring segments of the first surface 12 of the metal sheet 10 on either side of the second fold line 36 into increased opposition with each other.

As shown in FIG. 9, the bending of the metal sheet 10 about the second fold line 36 urges the first surface 12 of the metal sheet 10 on the second moved side 116 of the second fold line 36 into the first engagement surface 50 of the third stationary die block 38. The third stationary die block 38 has the first engagement surface 50 which engages the first surface 12 of the metal sheet 10 and is a complementary mirror image to the surface contour of the first surface 12 of the metal sheet 10.

Figure 10:
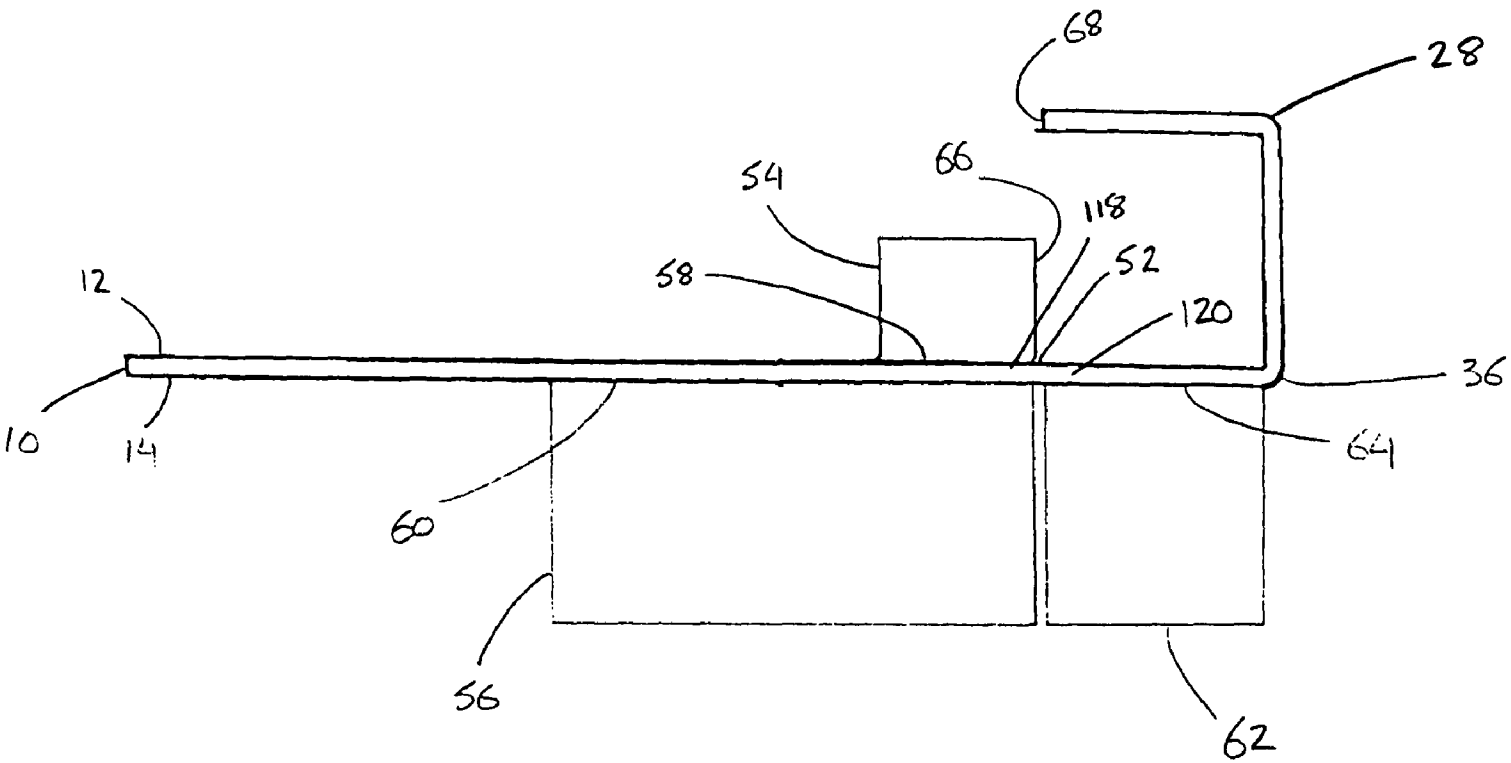
FIG. 10 is a side view of the variable gauge metal sheet of FIG. 9, wherein the metal sheet is secured between a fifth clamping die, and a sixth clamping die and a sixth moving die block is brought into engagement with the metal sheet.
Figure 11:
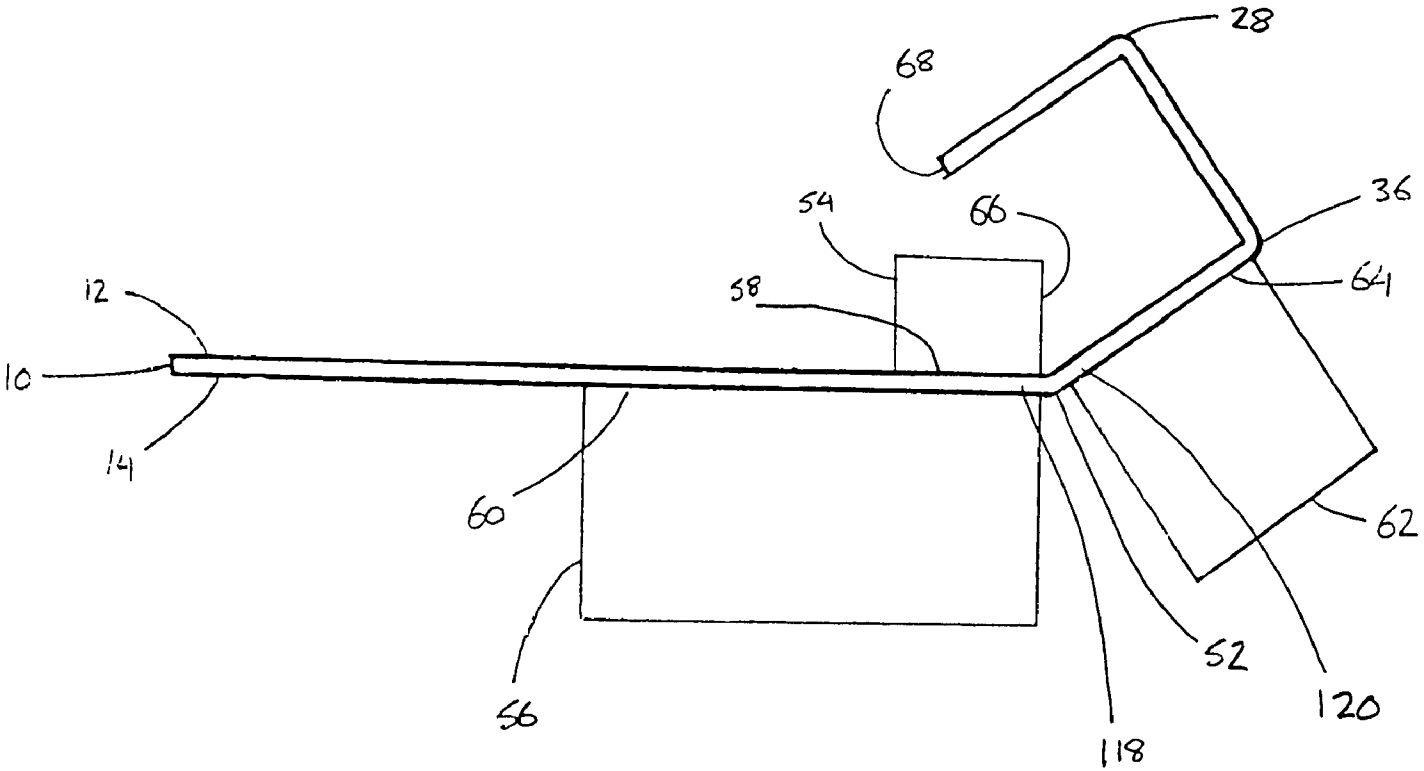
FIG. 11 is a side view of the variable gauge metal sheet of FIG. 10, wherein the sixth moving die block pushes up against the metal sheet to bend the metal sheet about a third fold line.
Figure 12:
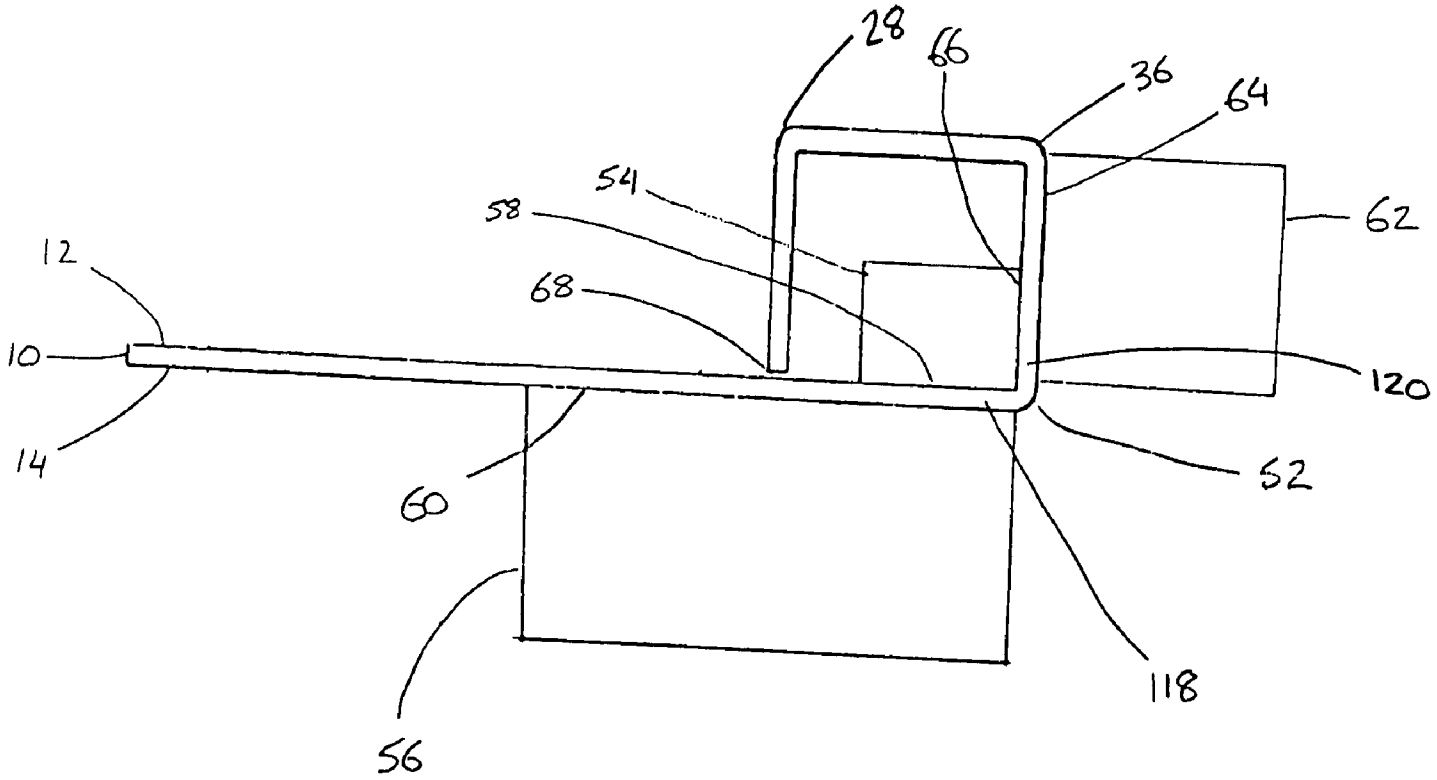
FIG. 12 is a side view of the variable gauge metal sheet of FIG. 11, wherein the, metal sheet has been bent about the third fold line, thus forming a third desired shape.

FIGS. 10 to 12 illustrate forming the metal sheet 10 into a third desired shape by bending the metal sheet 10 about a third fold line 52. The third fold line 52 extends through both the first portion 16 and the second portion 18 of the metal sheet 10. On either side of the third fold line 52 is a first clamped side 118 and a second moved side 120.

The metal sheet 10 is held on the first clamped side of the third fold line 52 between a fifth clamping die 54 and a sixth clamping die 56. The fifth clamping die 54 acts as a first clamping die in having a first engagement surface 58 which engages the first surface 12 of the metal sheet 10 and is a complementary mirror image to the surface contour of the first surface 12 of the metal sheet 10 that it engages. The sixth clamping die 56 has a second engagement surface 60 which engages the second surface 14 of the metal sheet 10 and is a complementary mirror image to the surface contour of the second surface 14 of the metal sheet 10 that it engages.

As shown in FIG. 10, a sixth moving die block 62 is moved into engagement with the second surface 14 of the metal sheet 10 on the second moved side 120 of the third fold line 52 to urge the first surface 12 of the metal sheet 10 on the second moved side of the third fold line 52. The sixth moving die block 62 has a second engagement surface 64 which engages the second surface 14 of the metal sheet 10 and is a complementary mirror image to the surface contour of the second surface 14 of the metal sheet 10 into which it is urged.

As shown in FIG. 11, the sixth moving die block 62 pushes up against the second surface 14 of the metal sheet 10 to bring segments of the first surface 12 of the metal sheet 10 on either side of the third fold line 52 into increased opposition with each other.

As shown in FIG. 12, the metal sheet 10 is bent about the third fold line 52 until a 90° angle is formed and the edge 68 of the metal sheet 10 contacts the first surface of the metal sheet 10 on the first clamped side 118 of the third fold line 52. The bending of the metal sheet 10 about the third fold line 52 urges the first surface 12 of the metal sheet 10 on the second moved side 120 of the third fold line 52 into the fifth stationary die block 54. The fifth stationary die block 54 also acts as a fifth stationary die block in having a first engagement surface 66 which engages the first surface 12 of the metal sheet 10 and is a complementary mirror image to the surface contour of the first surface 12 of the metal sheet 10.

Figure 13:
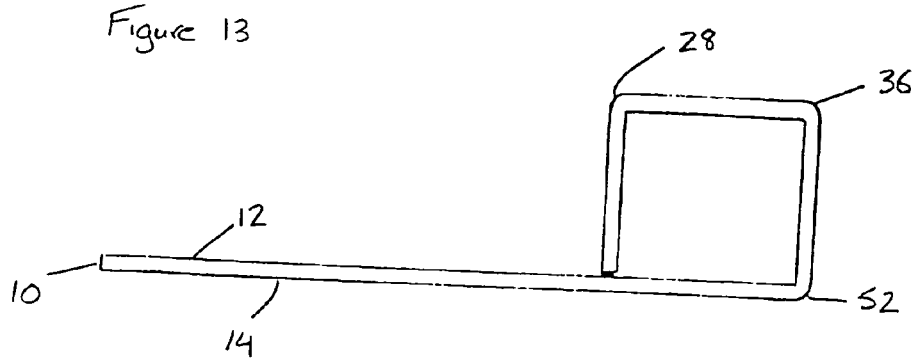
FIG. 13 is a side view of the variable gauge metal sheet that has been formed into a third desired shape.
Figure 14:
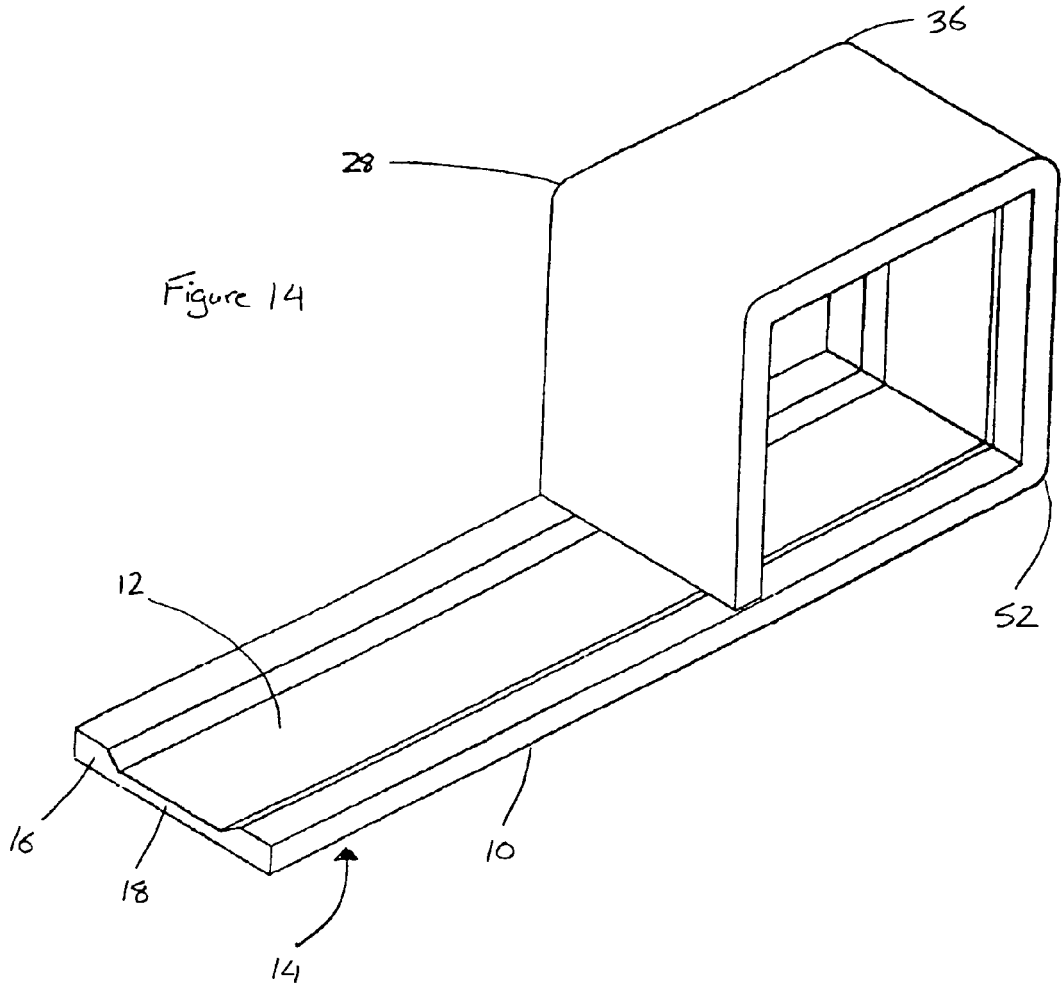
FIG. 14 is a perspective view of FIG. 13, wherein the variable gauge metal sheet that has been formed into the third desired shape.

FIGS. 13 and 14 illustrate the third desired shape, wherein the metal sheet 10 is bent about the first fold line 28, the second fold line 36 and the third fold line 54 at 90° angles. The edge 68 of the metal sheet 10 can be joined to the first surface 12 of the metal sheet 10 on the first clamped side 188 of the third fold line 52 by welding, preferably laser welding. As a result, a hollow tube having a variable thickness is formed.

Figure 15:
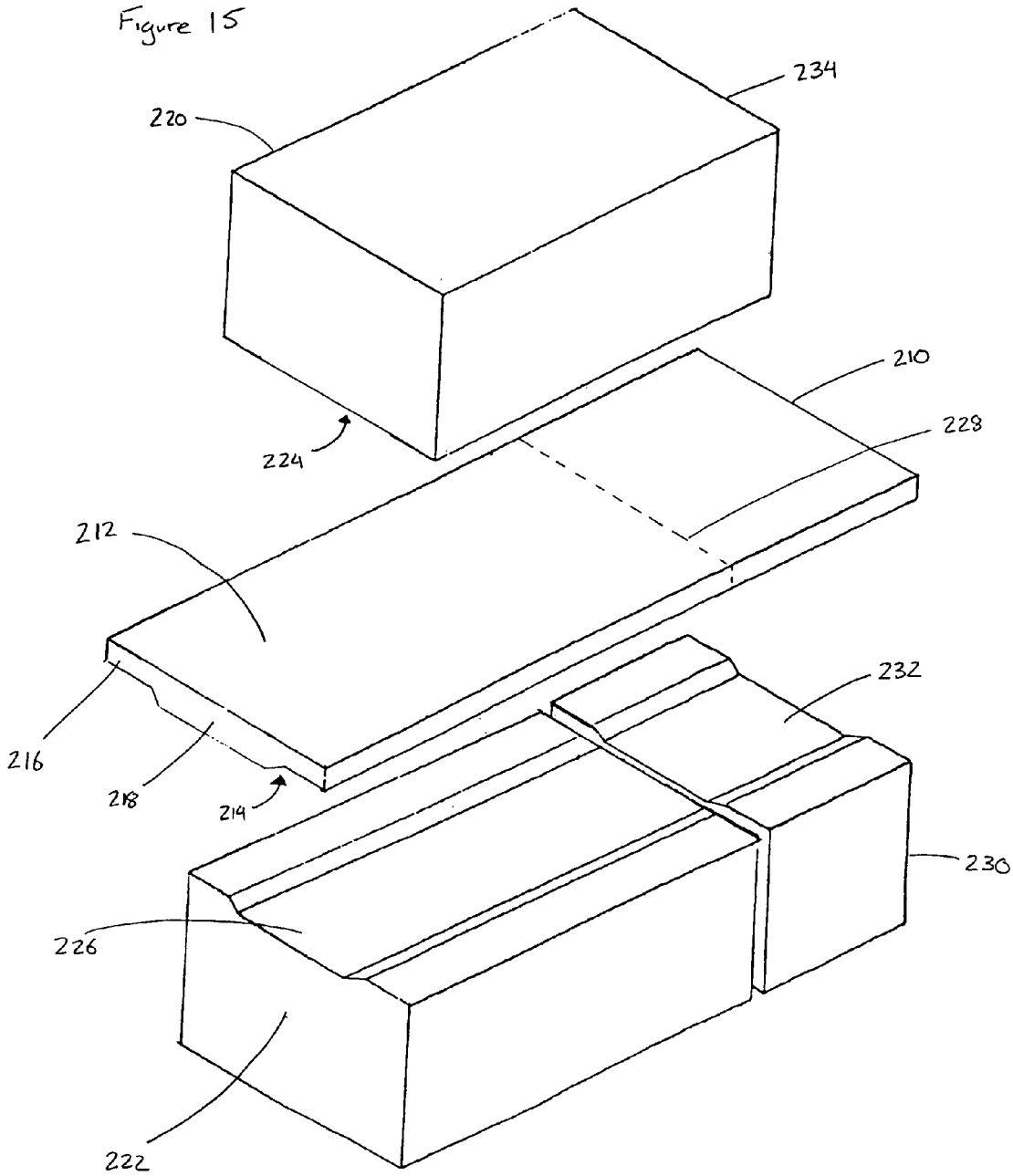
FIG. 15 is a perspective view of a variable gauge metal sheet, a first clamping die, a second clamping die and a second moving die block to be used in accordance with a second embodiment of the present invention.

FIG. 15 illustrates a variable gauge metal sheet 210 to be shaped by a process in accordance with a second preferred embodiment of the present invention. The variable gauge metal sheet 210 has a first surface 212 and a second surface 214. In contrast to the first preferred embodiment described above and shown in FIG. 1, in this second preferred embodiment shown in FIG. 15, the first surface 212 is planar, while the second surface 214 is non-planar.

The variable gauge metal sheet 210 has a thickness measured at any point on the metal sheet 210 as the distance between the first surface 212 and the second surface 214. As can be seen in FIG. 15, the thickness of the metal sheet 210 is smaller at a first portion 216 than at a second portion 218.

In this second preferred embodiment, the variable gauge metal sheet 210 is bent into a first desired shape. The metal sheet 10 is secured between a first clamping die 220 and a second clamping die 222. The first clamping die 220 acts as a clamping die in having a first engagement surface 224 which engages the first surface 212 of the metal sheet 210 and is a complementary mirror image to the surface contour of the first surface 212 of the metal sheet 210 that it engages. Similarly, the second clamping die 222 has a second engagement surface 226 which engages the second surface 214 of the metal sheet 210 and is a complementary mirror image to the surface contour of the second surface 214 of the metal sheet 210 that it engages.

In this preferred embodiment, the first clamping die 220 also acts as a first stationary die block in having a first engagement surface 234. A second moving die block 230 engages the second surface 214 of the metal sheet 210. The second moving die block 230 has a second engagement surface 232 which engages the second surface 214 of the metal sheet 210 and is a complementary mirror image to the surface contour of the second surface 214 of the metal sheet 210 into which it is urged. The second moving die block 230 pushes up against the second surface 214 of the metal sheet 210 to bend the metal sheet 210 about the first fold line 228. The bending of the metal sheet 210 about the first fold line 228 urges the first surface 212 of the metal sheet 210 into the first stationary die block 220. The first stationary die block 220 has the first engagement surface 234 which engages the first surface 212 of the metal sheet 210 and is a complementary mirror image to the surface contour of the first surface 212 of the metal sheet 210. In this second preferred embodiment, both surfaces 212 and 234 are planar.

Figure 16:
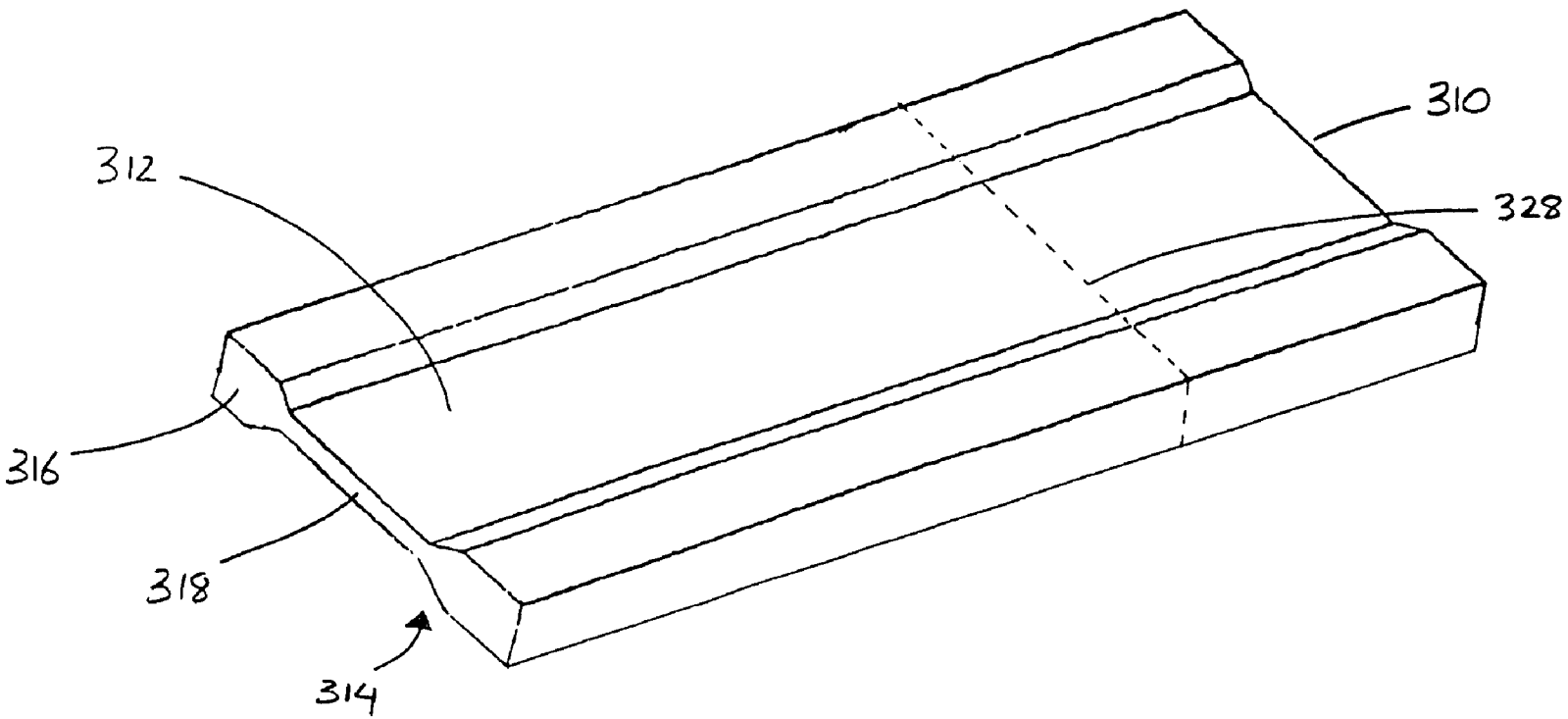
FIG. 16 is a perspective view of a variable gauge metal sheet to be used in accordance with a third embodiment of the present invention.

FIG. 16 illustrates a variable gauge metal sheet 310 to be shaped by a process in accordance with a third embodiment of the present invention. The variable gauge metal sheet 310 has a first surface 312 and a second surface 314. In contrast to the first and second preferred embodiments described above and shown in FIGS. 1 and 15, in this third preferred embodiment shown in FIG. 16, both the first surface 312 and the second surface 314 are non-planar.

The variable gauge metal sheet 310 has a thickness measured at any point on the metal sheet 310 as the distance between the first surface 212 and the second surface 214. As can be seen in FIG. 16, the thickness of the metal sheet 310 is greater at a first portion 316 than at a second portion 318.

The variable gauge metal sheet 310 of the third preferred embodiment is bend about first fold line 328 by a process similar to those described in the first and second preferred embodiments. As with the first and second preferred embodiments, the die blocks used in the process of the third preferred embodiments have engagement surfaces which are complementary mirror images of the first surface 312 or the second surface 314 of the metal sheet 310.

The process of the present invention can be used in a wide variety of applications where blank metal sheets are used to manufacture metal components. For example, metal sheets can be bent by the process of the present invention to form various automobile components. The process of the present invention is particularly useful for forming ties bars in a radiator support assembly.

Figure 17:
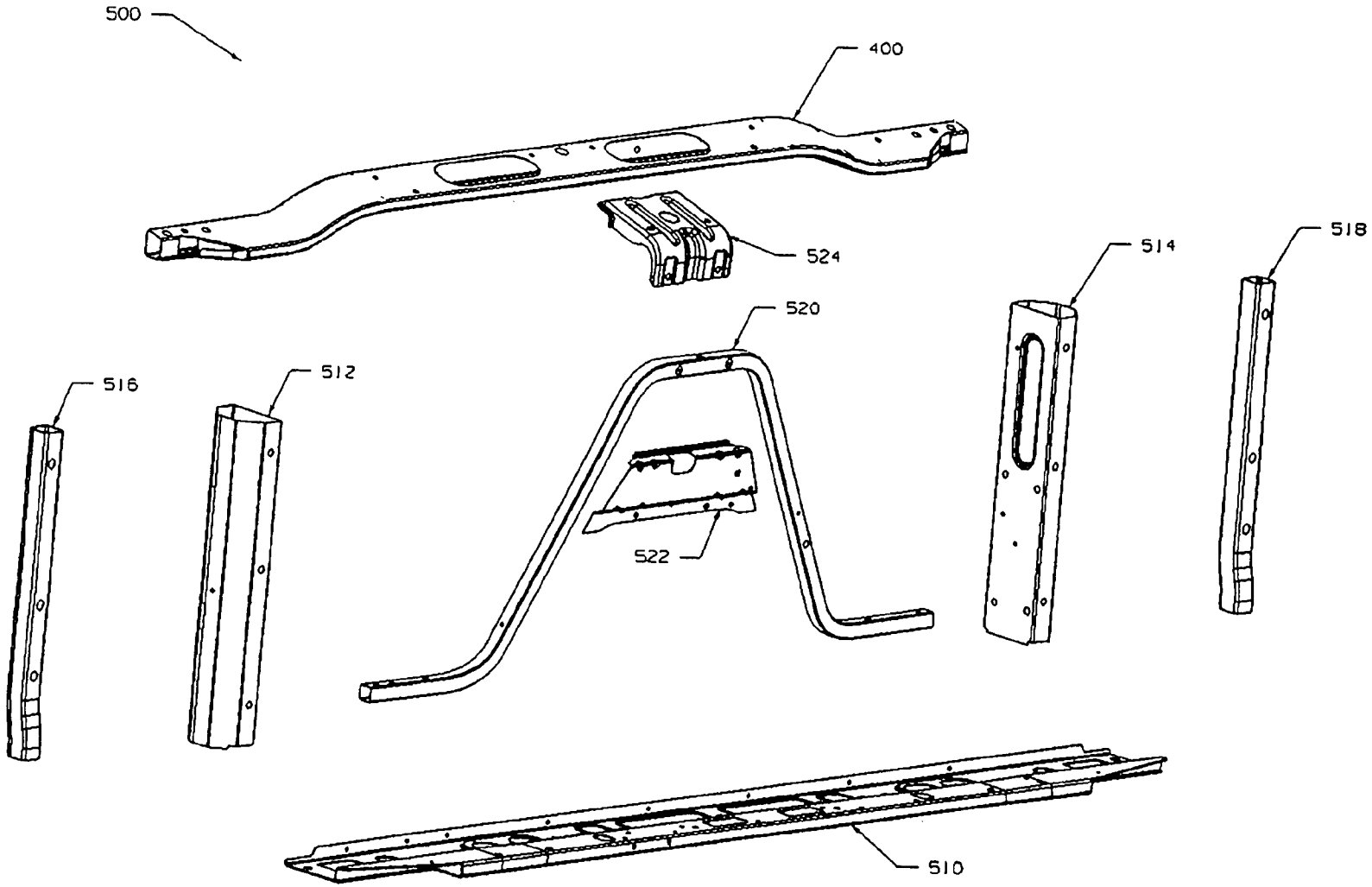
FIG. 17 is a perspective view of a radiator support assembly including an upper tie bar that has been formed into the desired shape by the process of the present invention.

FIG. 17 illustrates a radiator support assembly 500 for an automobile. The radiator support assembly 500 is typically located in front of the automobile engine and behind the radiator grille. This radiator support assembly 500 serves as a metal frame to support the radiator which is a device where hot engine coolant is circulated and cooled. In addition to the radiator, the radiator support assembly 500 also holds other vehicle parts such as the condenser, horn, headlights, grille and hood latch.

The radiator support assembly 500 comprises an upper tie bar 400, a lower tie bar 510, inner posts 512 and 514, outer posts 516 and 518, a cross brace 520, a hood latch mounting bracket 522 and a hood latch support bracket 524. The upper tie bar 400 and the lower tie bar 510 make up the upper and lower support structures of the support assembly 500. Inner posts 512 and 514 and outer posts 516 and 518 join the upper tie bar 400 and the lower tie bar 510. The radiator is to be held in place and protected between the upper tie bar 400 and the lower tie bar 510.

The radiator support assembly 500 is important in protecting and stabilizing the radiator, and therefore, must be durable. Generally, the radiator suppot assembly 500 comprises steel. At the same time, it is desirable for the radiator support assembly 500 to be of lightweight construction, for example to increase fuel economy of the automobile. Thus, it is desirable to form components of the radiator support assembly 500 from variable gauge metal sheets where possible.

As shown in FIGS. 18 to 21, each of the upper tie bar 400 and the lower tie bar 510 is elongate and has a middle portion 410 and two end portions 412 and 414. The two end portions 412 and 414 are the portions of the upper tie bar 400 which are joined to the lower tie bar 510 by the inner posts 512 and 514 and the outer posts 516 and 518. Therefore, for example, the end portions 412 and 414 of the upper tie bar 400 will be subjected to a greater load than the middle portion 410 of the upper tie bar 400. As such, in order to reduce the weight of each of the upper tie bar 400 and the lower tie bar 510, the middle portion 410 can be designed to be thinner than the end portions 412 and 414.

Figure 18:
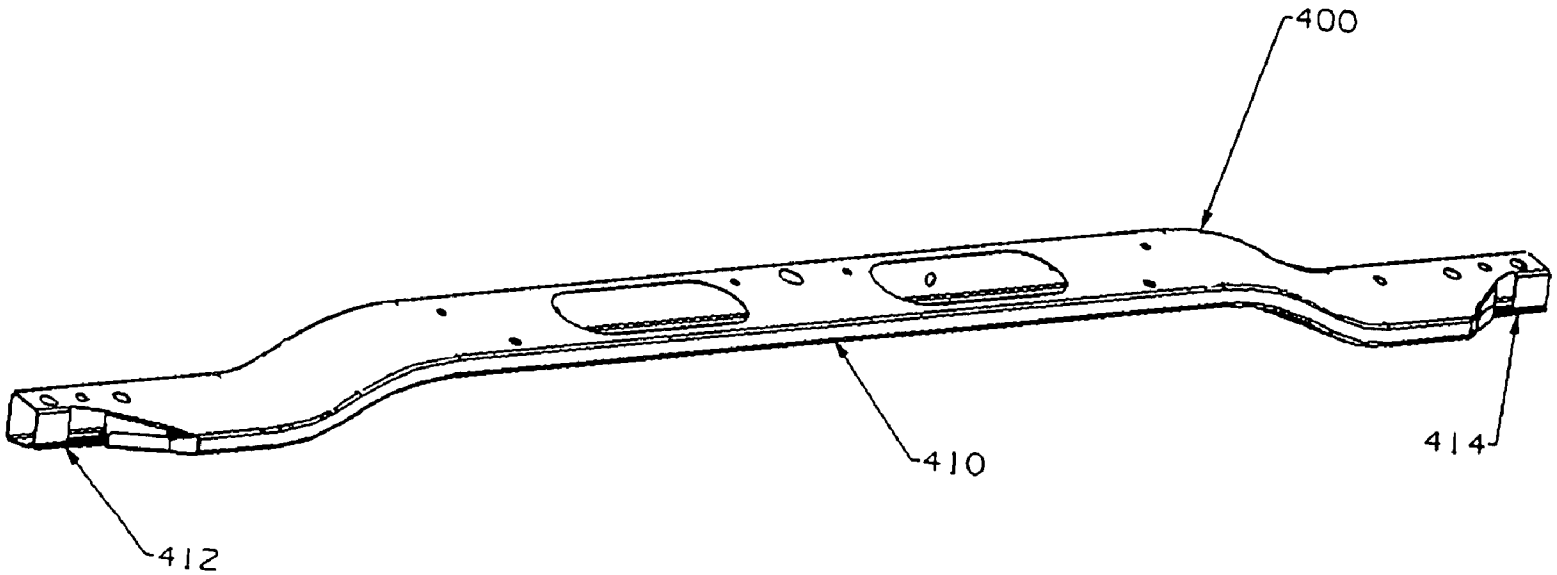
FIG. 18 is an isolated perspective view of the upper tie bar of FIG. 17.
Figure 19:
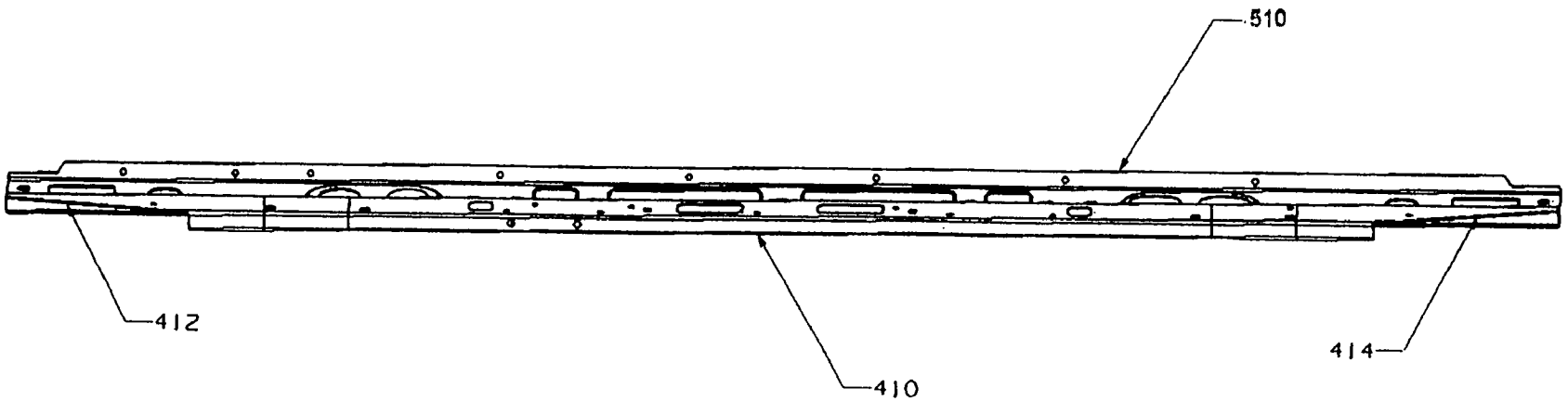
FIG. 19 is an edge view of the lower tie bar of FIG. 17.
Figure 20:
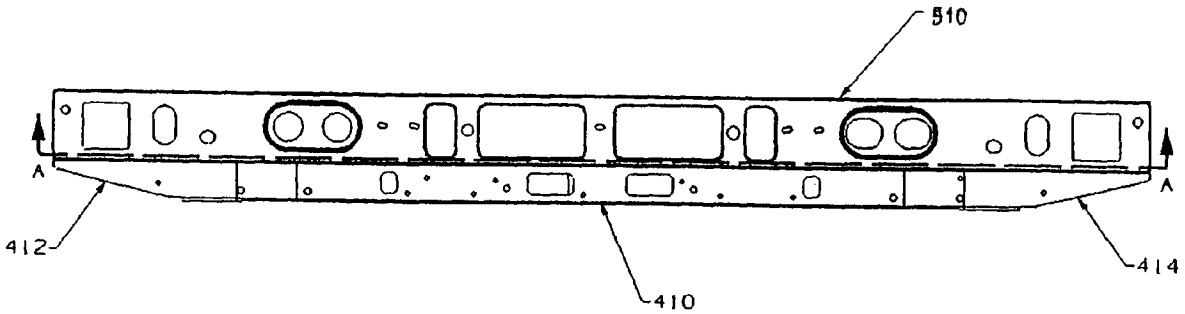
FIG. 20 is a top view of the tie bar of F*igure* 19.

FIG. 18 illustrates the upper tie bar 400 for a radiator support assembly of FIG. 17 which has been formed by the process of the present invention and shows the upper tie bar 400 having a tubular shape with four sides as seen at its end, and three folds extending longitudinally of the tie bar. FIG. 19 shows an edge view of the lower tie bar 510 of FIG. 17. This edge illustrates that the tie bar 510 has been bent across all of middle portion 410 and end portions 412 and 414. F*igure* 17 shows the lower tie bar 510 as having a U-shape as seen at its end, and two folds extending longitudinally of the tie bar. FIG. 20 is a top view of the lower tie bar 510 in FIG. 19.

Figure 21:
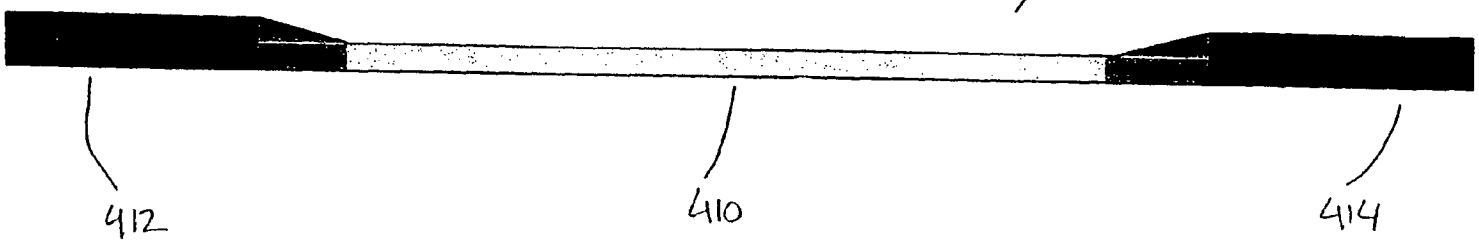
FIG. 21 is a cross-sectional view of the tie bar of FIG. 20 along section line A-A.

FIG. 21 illustrates a cross-sectional view of the top view of FIG. 20 along section line A-A in which the vertical dimension is not to scale but greatly exaggerated to show that the end portions 412 and 414 are greater thickness than the middle portion 410. The thickness of the lower tie bar 510 is greater at the end portions 412 and 414 that at the middle portion 410. The variable thickness profile of the upper tie bar 400 is designed such that the thinner middle portion 410 is subjected to a lesser load than the load applied to the thicker end portions 412 and 414. This is desirable because the tie bar 400 is lighter in weight than a tie bar which lacks a variable thickness profile. Furthermore, less metal material is required to form tie bar 400 than a tie bar which lacks a variable thickness profile.

By using the process of the present invention, the tie bar 400 can be bent into the desired shape along a straight fold line, wherein the fold line extends across the middle portion 410 and the end portions 414, without scratching or marking the surface of the tie bar 400.

Although this disclosure has described and illustrated preferred embodiments of the present invention, it is to be understood that the present invention is not restricted to these particular embodiments. Rather, the present invention includes all embodiments which are functional or mechanical equivalents of the specific embodiments and features that have been described and illustrated herein. Many modifications and variations will now occur to those skilled in the art. For a definition of the present invention, reference is made to the following claims.

The invention claimed is:

1. A process for forming a variable gauge metal sheet into a desired shape, said process comprising:

providing a variable gauge metal sheet having a first surface and a second surface along a longitudinal direction, the metal sheet having a thickness measured at any point on the metal sheet as a distance between the first surface and the second surface, the thickness of the metal sheet being different over a first portion of the sheet than over a second portion of the sheet along a transverse direction, and forming said metal sheet into a first desired shape by bending the metal sheet about a first fold line, said first fold line extending through both the first portion and the second portion, to bring segments of the first surface of the metal sheet on either side of the first fold line into increased opposition with each other, wherein said bending of the metal sheet about the first fold line is effected by holding the metal sheet on a first clamped side of the first fold line secured between a first clamping die and a second clamping die while applying forces to the second surface of the metal sheet on a second moved side of the first fold line, wherein the first clamping die has a first engagement surface which engages the first surface of the metal sheet and is a complementary mirror image to a surface contour of the first surface of the metal sheet that it engages, wherein the second clamping die has a second engagement surface which engages the second surface of the metal sheet and is a complementary mirror image to a surface contour of the second surface of the metal sheet that it engages.

2. The process according to claim 1, wherein said bending of the metal sheet about the first fold line urges the first surface of the metal sheet on the second moved side of the first fold line into a first stationary die block, said first stationary die block having a first engagement surface which engages the first surface of the metal sheet and is a complementary mirror image to the surface contour of the first surface of the metal sheet.

3. The process according to claim 2, wherein a second moving die block is moved into engagement with the second surface of the metal sheet on the second moved side of the first fold line to urge the first surface of the metal sheet on the second moved side of the first fold line into the first stationary die block, the second moving die block having a second engagement surface which engages the second surface of the metal sheet and is a complementary mirror image to the surface contour of the second surface of the metal sheet into which it is urged.

4. The process according to claim 3, wherein the second surface of the metal sheet has a surface contour which is a flat planar surface throughout the substantial entirety of the second surface in the same flat plane on either side of the first fold line before said bending.

5. The process according to claim 4, wherein the first fold line lies in the second surface of the metal sheet spaced away from the first surface of the metal sheet.

6. The process according to claim 1, wherein the bending of the sheet metal about the first fold line is effected by wing bending.

7. The process according to claim 1, wherein the first fold line extends along the metal sheet from a first end of the metal sheet to a second end of the metal sheet, with a central plane intermediate the ends of the metal sheet and normal to the first fold line, the thickness of the metal sheet being substantially symmetrical along the central plane.

8. The process according to claim 1, further comprising forming said metal sheet into a second desired shape by bending the metal sheet about a second fold line, said second fold line extending through both the first portion and the second portion to bring segments of the first surface of the metal sheet on either side of the second fold line into increased opposition with each other, wherein said bending of the metal sheet about the second fold line is effected by holding the metal sheet on a first clamped side of the second fold line secured between a third clamping die and a fourth clamping die while applying forces to the second surface of the metal sheet on a second moved side of the second fold line, the third clamping die having a first engagement surface which engages the first surface of the metal sheet and is a complementary mirror image to the surface contour of the first surface of the metal sheet that it engages, the fourth clamping die having a second engagement surface which engages the second surface of the metal sheet and is a complementary mirror image to the surface contour of the second surface of the metal sheet that it engages.

9. The process according to claim 8, wherein said bending of the metal sheet about the second fold line urges the first surface of the metal sheet on the second moved side of the second fold line into a third stationary die block, said third stationary die block having a first engagement surface which engages the first surface of the metal sheet and is a complementary mirror image to the surface contour of the first surface of the metal sheet.

10. The process according to claim 9, wherein a fourth moving die block is moved into engagement with the second surface of the metal sheet on the second moved side of the second fold line to urge the first surface of the metal sheet on the second moved side of the second fold line into the third stationary die block, the fourth moving die block having a second engagement surface which engages the second surface of the metal sheet and is a complementary mirror image to the surface contour of the second surface of the metal sheet into which it is urged.

11. The process according to claim 10, wherein the process is used to form an automotive component comprising an elongate tie bar for a radiator assembly having a U-shape in end view and with the first fold line and the second fold line extending longitudinally of the elongate tie bar.

12. The process according to claim 9, wherein the process is used to form an automotive component comprising an elongate tie bar for a radiator assembly having a U-shape in end view and with the first fold line and the second fold line extending longitudinally of the elongate tie bar.

13. The process according to claim 8, further comprising forming said metal sheet into a third desired shape by bending the metal sheet about a third fold line, said third fold line extending through both the first portion and the second portion to bring segments of the first surface of the metal sheet on either side of the third fold line into increased opposition with each other, wherein said bending of the metal sheet about the third fold line is effected by holding the metal sheet on a first clamped side of the third fold line secured between a fifth clamping die and a sixth clamping die while applying forces to the second surface of the metal sheet on a second moved side of the third fold line, the fifth clamping die having a first engagement surface which engages the first surface of the metal sheet and is a complementary mirror image to the surface contour of the first surface of the metal sheet that it engages, the sixth clamping die having a second engagement surface which engages the second surface of the metal sheet and is a complementary mirror image to the surface contour of the second surface of the metal sheet that it engages.

14. The process according to claim 13, wherein said bending of the metal sheet about the third fold line urges the first surface of the metal sheet on the second moved side of the third fold line into a fifth stationary die block, said fifth stationary die block having a first engagement surface which engages the first surface of the metal sheet and is a complementary mirror image to the surface contour of the first surface of the metal sheet.

15. The process according to claim 14, wherein a sixth moving die block is moved into engagement with the second surface of the metal sheet on the second moved side of the third fold line urge the first surface of the metal sheet on the second moved side Of the third fold line into the fifth stationary die block, the sixth moving die block having a second engagement surface which engages the second surface of the metal sheet and is a complementary mirror image to the surface contour of the second surface of the metal sheet into which it is urged.

16. The process according to claim 14, wherein the process is used to form an automotive component comprising an elongate tie bar for a radiator support assembly having a tubular shape in end view and with the first fold line, the second fold line and the third fold line extending longitudinally of the elongate tie bar.

17. The process according to claim 13, wherein said third desired shape is a hollow tube.

18. The process according to claim 17, wherein the process is used to form an automotive component comprising an elongate tie bar for a radiator support assembly having a tubular shape in end view and with the first fold line, the second fold line and the third fold line extending longitudinally of the elongate tie bar.

19. The process according claim 13, wherein the process is used to form an automotive component comprising an elongate tie bar for a radiator support assembly having a tubular shape in end view and with the first fold line, the second fold line and the third fold line extending longitudinally of the elongate tie bar.

20. The process according to claim 8, wherein the process is used to form an automotive component comprising an elongate tie bar for a radiator assembly having a U-shape in end view and with the first fold line and the second fold line extending longitudinally of the elongate tie bar.

* * * * *